United States Patent [19]

Becker et al.

[11] 4,187,184

[45] Feb. 5, 1980

[54] SOFTENING COMPOSITION

[75] Inventors: Gert Becker, Weinheim, Fed. Rep. of Germany; Ulrich Schilp, Vlaardingen, Netherlands; Hans F. Barth, Wiesloch, Fed. Rep. of Germany

[73] Assignee: Lever Brothers Company, New York, N.Y.

[21] Appl. No.: 961,273

[22] Filed: Nov. 16, 1978

[30] Foreign Application Priority Data

Nov. 16, 1977 [GB] United Kingdom ..... 47691/77

[51] Int. Cl.[2] ..... D06M 13/36

[52] U.S. Cl. ..... 252/8.8; 8/115.6; 252/8.6

[58] Field of Search ..... 252/8.8, 8.6; 8/115.6

[56] References Cited

U.S. PATENT DOCUMENTS

| | | | |
|---|---|---|---|
| 3,395,100 | 7/1968 | Fisher et al. | 252/8.8 |
| 3,424,609 | 1/1969 | Carl et al. | 252/8.8 |
| 3,729,416 | 4/1973 | Bruning et al. | 252/8.8 |
| 4,045,361 | 8/1977 | Watt | 252/8.8 |

FOREIGN PATENT DOCUMENTS

| | | |
|---|---|---|
| 1129648 | 1/1957 | France . |
| 1240713 | 7/1969 | United Kingdom . |

*Primary Examiner*—William E. Schulz
*Attorney, Agent, or Firm*—Melvin H. Kurtz

[57] ABSTRACT

The invention provides a fabric-softening composition comprising 1–80% by weight of a quaternary ammonium compound, such as distearyl dimethyl ammonium chloride, and 0.5–25% by weight of a fatty acid choline ester salt. The composition provides for an improved anti-static activity.

4 Claims, No Drawings

SOFTENING COMPOSITION

The invention relates to a fabric-softening agent on the basis of quaternary ammonium compounds.

Fabric-softening agents have already been known for a long time. Usually they are weakly acidic to weakly alkaline compositions which, besides water, organic solvents, perfumes, colorants, bactericides etc., contain as active substance a compound softening the fibres. Mostly a cationic, surface-active compound is used for this purpose, specifically a quaternary ammonium compound.

The prior art mentions a great number of suitable quaternary ammonium compounds of all kinds, but in practice especially the quaternary ammonium compounds of the following formula are used:

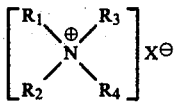

in which $R_1$ and $R_2$ are alkyl groups with 8–22 C atoms, $R_3$ and $R_4$ are alkyl groups with 1–3 C atoms and X is a quaternizing anion, such as a halogenide, sulphate, methosulphate or acetate anion.

A typical representative of this group is distearyl dimethylammonium chloride.

These fabric-softening agents are used in the rinsing stage of the washing process where they can impart a good feel and, simultaneously, antistatic properties to the fabric. This applies in the first place to cotton fabric, but, although these known fabric-softening agents can also have a good effect on other fabrics of the synthetic type, this effect is less pronounced than with cotton fabrics.

However, as fabrics of this kind, manufactured from synthetic fibres such as polyamides, polyesters, polyacrylates etc., can become electrostatically charged when being worn or so on, attempts have been made to manufacture a fabric-softening agent that is also suitable for fabrics of this kind.

It is therefore the aim of the invention to provide a fabric-softening agent that is not only suitable for cotton fabrics but also and especially for synthetic fabrics.

As solution of this problem it has now been found that by including a choline ester in a fabric-softening agent on the basis of the quaternary ammonium compounds described above a fabric-softening agent is obtained that is suitable both for cotton fabrics and synthetic fabrics. In particular, this fabric-softening agent has an improved antistatic activity on the synthetic fabrics.

It is true that traditional fabric-softening agents on the basis of dimethyl distearylammonium chloride also have, to a certain extent, the effect of rendering synthetic fabrics antistatic. However, as has been discovered, besides the relatively weak antistatic activity, they have a further disadvantage. On storage of a treated synthetic fabric under climatized conditions (e.g. 20° C./60–65% RH) longer than the 48 hours usually spent on such tests, after 1 to 3 weeks a distinct decline in the antistatic activity is revealed compared with the beginning of the storage.

By addition of the choline esters according to the invention this decline in the antistatic activity of the fabric-softening agent, caused by storage, can now be reduced to a large extent.

Suitable as choline esters to be used according to the invention are the compounds characterized by the following formula:

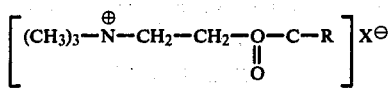

in which R is an alkyl group with 6–24 C atoms and X is a monovalent anion such as a halogenide, nitrate, methosulphate or acetate anion.

These choline fatty acid esters and their salts are known per se, e.g. from French patent specification No. 1,129,648 and from Lindner "Textilhilfsmittel und Waschrohstoffe", Volume 1 (1964), page 977. They can be prepared by known methods, e.g. by reaction of fatty acids with ethylene halohydrin and subsequent reaction of the reaction product with trimethylamine, by reaction of choline chloride with fatty acid chlorides or by reaction of fatty acid chlorides with dimethylaminoethanol and subsequent quaternizing of the ester obtained.

Particularly suitable according to the invention are those choline esters of which the alkyl group R has 12–22, preferably 16–22 C atoms. The alkyl group R in the above formula can have a slightly branched chain but preferably it has a straight chain. It can be unsaturated but is preferably saturated. The anion X in the above formula is preferably the chloride anion. The fabric-softening agent according to the invention generally contains the choline esters in amount of 0.5 to 25, preferably 1 to 10% by weight.

As already mentioned above, the fabric-softening agent further contains a fibre-softening quaternary ammonium compound of the formula given above. The preferred quaternary ammonium compound is distearyl dimethylammonium chloride. These compounds are generally present in the fabric-softening agent according to the invention in an amount of 1–80%, preferably 5–50% by weight. The term "quaternary ammonium compound" does not embrace the choline ester salts. The fabric-softening agent can also contain other additives usual in such agents, such as organic solvents, moisturizers, perfumes, bactericides, colorants, preservatives, buffers, thickeners, suspending agents, hydrotropes, agents preventing the redeposition of soil on the fabric, etc.

Further it was found that the fabric-softening agents according to the invention could be improved even more if also certain agents which prevent the redeposition of soil on synthetic fabrics in particular are added to them. Particularly suitable as such agents are polyethyleneterephthalate copolymers, such as e.g. a copolymer of polyethyleneterephthalate and polyoxyethyleneglycol as described in British patent specification No. 1,088,984. A typical representative of these agents is the commercially available product Permalose® T ex I.C.I. Another representative of these agents is the product Zelcon® TGF ex E. I. du Pont de Nemours. Through use of these agents in addition, the absorption capacity of the various fabrics treated with the fabric-softening agent was improved, particularly that of the synthetic fabrics.

Generally these polyethyleneterephthalate copolymers are used in an amount of 0.5–10% by weight, preferably 1-5% by weight, in the fabric-softening agent according to the invention. The agents according to the invention can be manufactured in solid, pasty or, preferably, liquid form. Generally they have a pH between 6 and 8, which can be adjusted by means of suitable pH-regulating additives .

The invention is now further explained with the aid of the following Examples.

EXAMPLE I

Three samples were prepared having the following composition. Samples I-II are according to the invention; sample A is according to the prior art and serves as control.

| | A | I | II |
|---|---|---|---|
| Distearyl dimethylammonium chloride (100%) | 6 | 6 | 6 |
| Tallow fatty acid choline ester chloride (100%) | — | 2 | 2 |
| Permalose® T (ex I.C.I.) (100%) | — | — | 5 |
| Perfume | 0.3 | 0.3 | 0.3 |
| NaCl | 0.003 | 0.003 | 0.003 |
| Colorant | 0.0018 | 0.0018 | 0.0018 |
| Water to | 100 | 100 | 100 |

Samples A, I and II were tested as follows, with respect to their softening activity, on cotton fabrics ("frottée") (terry-towel) 30×30 cm frottée fabrics were washed twice in the Tergotometer with 8 g/l of a heavy duty washing agent at 15° GH, cloth/liquor ratio 1:20, for 20 min. at 95° C. (heating time 20 min.).

Seven fabrics were separately rinsed by hand for 5 min. with each of the test samples (15° GH, cloth/liquor ratio 1:50), with a dosage of 116 ml of sample per 3.6 kg of fabric. The fabrics were then centrifuged for 1 min. and dried on the line.

The normal fabric softener sample A was compared each time in pairs with samples I and II by asking the question: "Which fabric is softer?"

For that purpose for each sample 7 fabrics (folded twice) were judged four times in each case by 7 people, so that this gave a total of 28 evaluations.

The following results were obtained:

| | Preferences | | | no |
|---|---|---|---|---|
| Comparison | Sample A | Sample I | Sample II | difference |
| Sample A/ Sample I | 7 | 18 | — | 3 |
| Sample A/ Sample II | 14 | — | 12 | 2 |
| $X^2$ | — | 2.57 | 0.07 | |
| Level of Significance | — | <90% | — | |

From this it appears that with respect to the softening activity on cotton fabrics sample II was the same as sample A and sample I was superior to sample A.

EXAMPLE II

Samples A, I and II were tested as follows with respect to their antistatic activity.

The fabrics polyester piqué, polyester/cotton 65/35 and polyacryl were washed twice in the Tergotometer with 6 g/l of a 60° C. washing agent at 15° GH, cloth-/liquor ratio 1:50, for 10 min. at 60° C. (heating time 10 min.).

Per kind of fabric and sample each time 5 fabrics (25×25 cm) were rinsed as in Example I, but with a dosage of 116 ml of sample per 1.9 kg of fabric.

After the rinsing, 4 more washing and rinsing cycles were carried out and subsequently the measurements were taken.

From each of the above-mentioned fabrics 2 equal strips sized 23.5×7.5 cm were cut off and after climatization for 24 hours their electrostatic properties were determined.

For that purpose the fabrics were fixed on top of an earth-connected, slanting metal plate placed at an angle of 30° to the vertical axis. Thereafter the fabrics were electrically charged by means of a high voltage point discharge of 10 kv, as a result of which they were attracted by the metal plate. The time until the test fabrics dropped off (thus after the charge had dissipated) was measured as dropping time. The shorter the dropping time the better the antistatic effect.

The following results were obtained:

| | Dropping time of the test fabrics in sec. | | |
|---|---|---|---|
| | Sample A | Sample I | Sample II |
| Polyester pique' | 10 min | 41 | 6 |
| Polyester/cotton 65/35 | 5 | 5 | 4 |
| Polyacryl | 15 | 1 | 3 |

From this it appears that, particularly with respect to the antistatic activity on polyester fabrics, samples I and II are superior to sample A.

EXAMPLE III

The samples A, I and a modified sample II, containing 3% of Permalose® T instead of 5%, were tested with respect to their antistatic activity during storage.

Fabrics from polyester (PES) and polyamide (PA) were pre-washed twice with a light duty detergent as in Example II.

Per kind of fabric and sample each time two strips (8×20 cm) were treated in the Tergotometer with a dosage of the samples of 2.5 g/l, cloth/liquor ratio 1:20, for 15 minutes. The fabrics were centrifuged briefly, dried in the open and climatized for one night at 20° C./60-65% RH. The susequently measured value of the dropping time was taken as the starting value for the beginning of the storage. Thereafter the strips were stored for three weeks at 20° C./60-65% RH.

The following results were obtained:

| | Dropping time of the test fabrics in sec. | | | | | | | |
|---|---|---|---|---|---|---|---|---|
| Storage time | Beginning of Storage | | 1 week | | 2 weeks | | 3 weeks | |
| Fabric | PES | PA | PES | PA | PES | PA | PES | PA |
| Sample A | 7 | 26 | 45 | 115 | 175 | 260 | 292 | 491 |
| Sample I | 3 | 23 | 18 | 85 | 85 | 255 | 142 | 514 |
| Sample II | 4 | 23 | 12 | 105 | 43 | 190 | 29 | 327 |

The tested fabrics thus showed a reduced decline in the antistatic activity after storage because of sample I and to an increased degree because of sample II.

EXAMPLE IV

Sample II of Example I was tested with respect to its effect on the absorption capacity of polyethylene fabrics as well as to its soil-releasing activity on polyester fabrics.

Measuring the Absorption Capacity

Per sample, two strips (25×4 cm) of the rinsed fabrics were cut in longitudinal direction so that 10 measurements could be carried out, from which an average value was taken.

After climatization for one night at 20° C./63% RH the fabrics were measured on a drip-on measuring device. The spark plug gap was 11.6 cm, the strips were stretched with a tensile force of 100 lbs and the amount of water dripping was 0.51 ml per minute.

Soil Release

After the fifth rinsing cycle as in Example II, 1 droplet of dirty motor oil was caused to drip on to each two fabrics and aged for one night. Then, as in Example II, the fabrics were washed once and the stain remaining was judged according to a five-point scale (5=stain present and unchanged, 1=stain completely removed).

The following results were obtained:

| | Sample A | Sample II |
|---|---|---|
| Absorption capacity | 427 sec. | 242 sec. |
| Soil release after 5 washing/rinsing cycles | 5 | 1.5 |

Sample II was thus superior to sample A with respect to the absorption and the soil-releasing activity on polyester fabrics.

We claim:

1. Fabric-softening agent on the basis of quaternary ammonium compounds, characterized in that it has further a content of choline ester salts of the following formula:

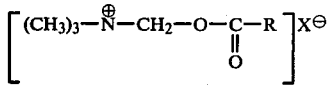

in which R is an alkyl group with 6–24 C atoms and X is a monovalent anion.

2. Agent according to claim 1, characterized in that it contains from 0.5–25% by weight of the choline ester salt.

3. Agent according to claim 1 or 2, characterized in that further it also contains a soil-release agent.

4. Agent according to claim 3, characterized in that it contains a copolymer of polyethyleneterephthalate and polyoxyethyleneglycol.

* * * * *

UNITED STATES PATENT AND TRADEMARK OFFICE

CERTIFICATE OF CORRECTION

PATENT NO. : 4,187,184

DATED : February 5, 1980

INVENTOR(S) : Becker et al.

It is certified that error appears in the above-identified patent and that said Letters Patent are hereby corrected as shown below:

In the Specification:

Column 2, lines 6-10: change

" $$\left[(CH_3)_3-\overset{\oplus}{N}-CH_2-CH_2-\underset{\underset{O}{\|}}{O-C}-R\right]X^{\ominus}$$ "

to -- $$\left[(CH_3)_3-\overset{\oplus}{N}-CH_2-CH_2-O-\underset{\underset{O}{\|}}{C}-R\right]X^{\ominus}$$ --

UNITED STATES PATENT AND TRADEMARK OFFICE

CERTIFICATE OF CORRECTION

PATENT NO. : 4,187,184

DATED : February 5, 1980

INVENTOR(S) : Becker et al.

It is certified that error appears in the above-identified patent and that said Letters Patent are hereby corrected as shown below:

In the Claims:

In claim 1, column 6, lines 15-20: change

" $\left[ (CH_3)_3 - \overset{\oplus}{N} - CH_2 - O - \underset{\underset{O}{\|}}{C} - R \right] X^{\ominus}$ "

to -- $\left[ (CH_3)_3 - \overset{\oplus}{N} - CH_2 - CH_2 - O - \underset{\underset{O}{\|}}{C} - R \right] X^{\ominus}$ --

Signed and Sealed this

*Seventeenth* Day of *February 1981*

[SEAL]

*Attest:*

*Attesting Officer*

RENE D. TEGTMEYER

*Acting Commissioner of Patents and Trademarks*